US005706979A

United States Patent [19]

Harris

[11] Patent Number: 5,706,979

[45] Date of Patent: Jan. 13, 1998

[54] TUBE CAP AND HANGER

[75] Inventor: Joseph W. Harris, Cincinnati, Ohio

[73] Assignee: J.W. Harris Co., Inc., Cincinnati, Ohio

[21] Appl. No.: 656,945

[22] Filed: Jun. 6, 1996

[51] Int. Cl.[6] ..... A47F 1/04

[52] U.S. Cl. ..... 221/307; 206/443

[58] Field of Search ..... 221/238, 232, 221/247, 276, 268, 271, 312 R; 206/336, 443, 528, 470, 469

[56] References Cited

U.S. PATENT DOCUMENTS 4,266,667 5/1981 Ishigaki ..... 206/443

*Primary Examiner*—Kenneth Noland

*Attorney, Agent, or Firm*—Palmatier, Sjoquist, Helget & Voight, P.A.

[57] ABSTRACT

A flexible cap adapted to enclose a tube having an open end and used for storing items consists of an enclosure having an opening at one end, a closed end, and side walls and enclosing a space. A pair of aligned apertures through the side walls form with the space a bore through the enclosure transverse to the axis of the enclosure between the opening and the closed end. The opening is adapted to engage the open end of the tube. To dispense an item, the cap is bent by lateral flexion so as to align one of the apertures with the open end of the tube and the tube is inverted so that an item falls out under the influence of gravity. The amount of lateral flexion controls the alignment of the aperture with the open end so as to permit only one item at a time to fall out.

16 Claims, 2 Drawing Sheets

TUBE CAP AND HANGER

BACKGROUND OF THE INVENTION

The invention relates to a storage device for items such as welding rods, drill bits or small items such as pieces of candy.

In industry and in the home it is often necessary to keep a store of elongate items such as welding rods or drill bits. For example, in the welding industry a supply of long welding rods must be kept on hand to feed a welding gun as each rod is used up. In the home, it is necessary to keep a supply of drill bits of varying thickness as replacement items, because drill bits tend to break. For consumer use, small items such as candy must be conveniently stored and dispensed for use.

Such items are typically packaged and stored in tubes. To keep the items from falling out of the tubes during storage, the tube must be capped. However, when it comes time to dispense one of the items, it has generally been necessary to remove the cap from the tube. Typically, the tube is of such diameter that it is difficult or impossible to simply insert the fingers into the tube to grab an item. Therefore, it is typical to invert the tube after removing the cap so that the item falls out under the influence of gravity.

The problem with such an approach is that more than one of the items may fall out of the tube, and it may not be possible to catch the falling items so that the items fall onto the floor, either breaking them or contaminating them.

Another problem with past storage devices is that the owner will typically wish to hang the storage device on the wall of the workshop to get it out of the way. This has required a hook to be molded into the tube cap increasing the cost of manufacture.

There is a need for a flexible cap for enclosing a tube used for storing items. There is also the need for an improved storage tube and dispenser cap for candy or other small items.

The cap should allow an item to be dispensed from the tube without removing the cap from the tube. The cap should also prevent more than one item from falling out of the tube during the dispensing process. The cap should also be hangable on a hook without special molding.

SUMMARY OF THE INVENTION

A flexible cap adapted to enclose a tube having an open end and used for storing items consists of an enclosure having an opening at one end, a closed end, and side walls and enclosing a space. A pair of aligned apertures through the side walls form with the space a bore through the enclosure transverse to the axis of the enclosure between the opening and the closed end. The opening is adapted to engage the open end of the tube. To dispense an item, the cap is bent by lateral flexion so as to align one of the apertures with the open end of the tube and the tube is inverted so that an item falls out under the influence of gravity. The amount of lateral flexion controls the alignment of the aperture with the open end so as to permit only one item at a time to fall out.

A principal object and advantage of the present invention is that the cap allows an item to be dispensed from the tube without removing the cap from the tube.

Another object and advantage of the present invention is that the cap prevents more than one of the items from accidently being dispensed from the tube.

Another object and advantage of the present invention is that the cap uses an aperture for both dispensing the item and for engaging a hook to hang the cap and tube on the wall.

DETAILED DESCRIPTION OF THE PREFERRED EMBODIMENTS

Figure 3:
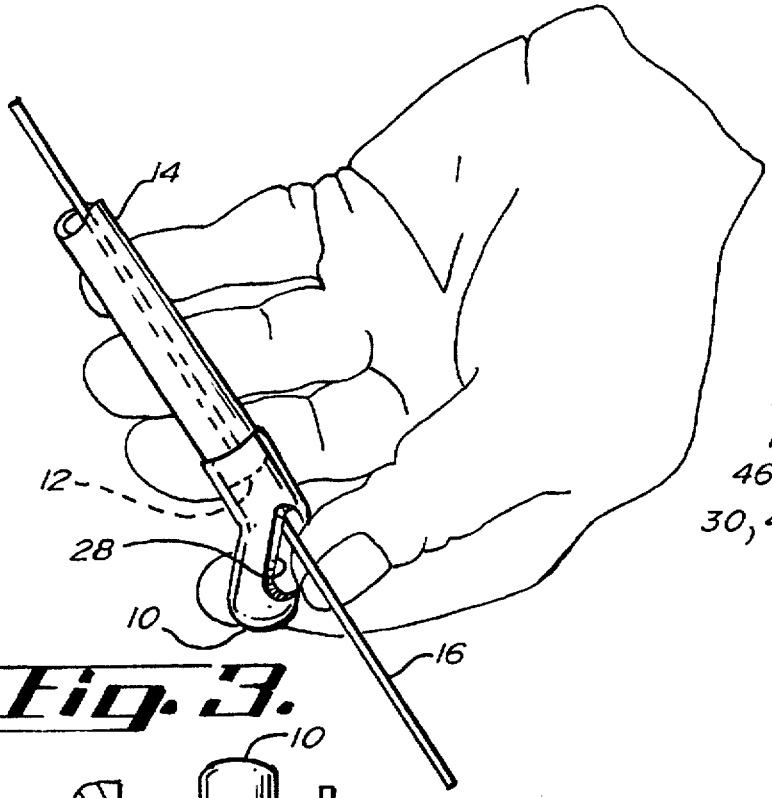
FIG. 3 is a perspective view showing the invention being used to dispense an elongate item.

The flexible cap of the present invention is shown generally in the Figures as reference numeral 10.

The flexible cap 10 is inserted on the open end 12 of a storage tube 14 containing elongate articles 16. The elongate articles 16 may variously be welding rods, drill bits, or any other long, thin article.

The cap may be described as having a flexible housing 10 having an outer wall 20 and inner wall 22. A space 24 is enclosed within the inner wall 24.

A bore 26 transects the outer wall 20, inner wall 22, and space 24 and forms apertures 28 at the intersection of the bore 26 with walls 20, 22.

An opening 30 through the outer wall 20 and inner wall 22 intersects the space 24. The opening 30 is adapted to engage the open end 12 of the storage tube 14.

It will be seen that this engagement puts the space 24 in communication with the open end 12.

The cap 10 may alternatively be described as an enclosure 40 having an opening 42 at one end, a closed end 44, and a side wall 46 and enclosing a space 24. An aperture 28 through the side wall 46, intersects the space 24 between the opening 42 and the closed end 44; the opening 42 being adapted to engage the open end 12 of the tube 14.

Figure 1:
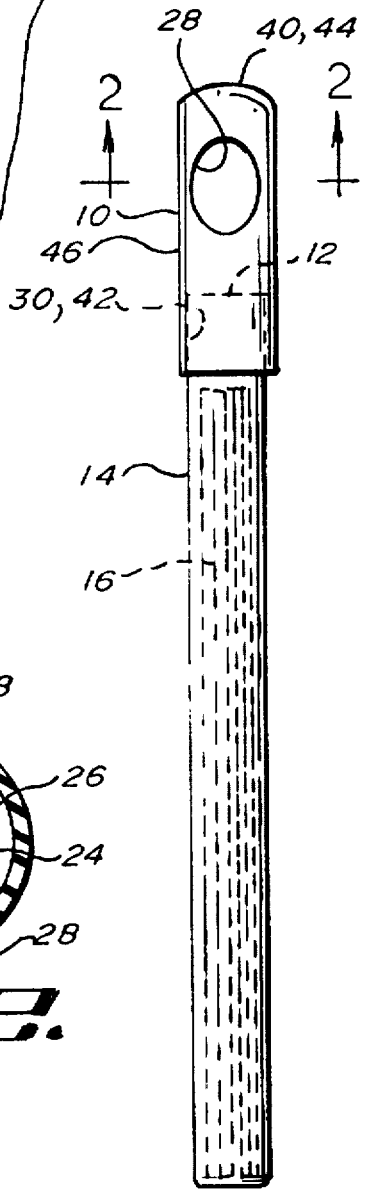
FIG. 1 is a side elevational view of the present invention.
Figure 2:
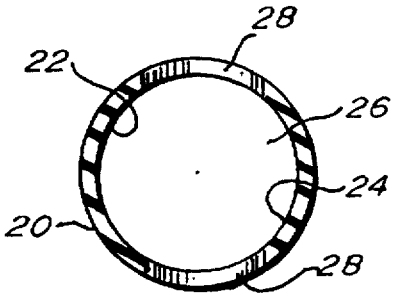
FIG. 2 is a cross section along the lines 2–2 in FIG. 1.
Figure 4:
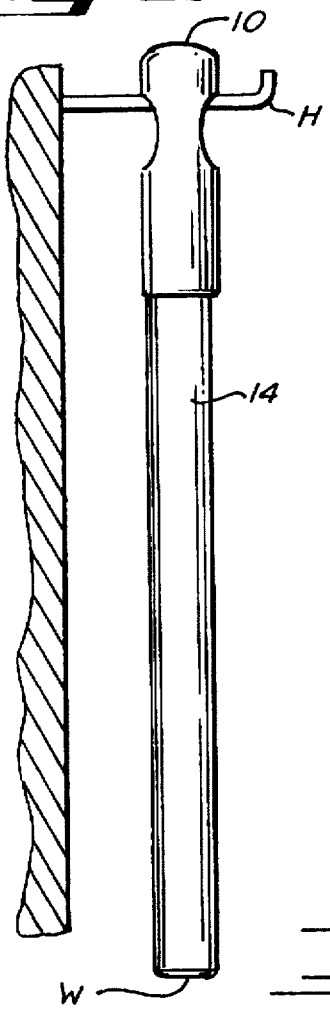
FIG. 4 shows the invention being hung on a wall hook.

When the cap 10 is in the position shown in FIG. 1, it is difficult to impossible for any of the elongate items 16 to fall out of the tube 14, because any item falling out of the tube 14 would come up against the cap 10. The elongate items are too long and inflexible to bend enough to go through the apertures 28.

However, when the tube is inverted as shown in FIG. 3, the cap may be bent by lateral flexion to align one of the apertures 28 with the open end 12 of the tube, thereby allowing an elongate item 16 to be dispensed from the tube under the influence of gravity without removing the cap 10. The alignment of the aperture 28 may be controlled by the amount of lateral flexion so as to prevent more than one elongate item 16 from being dispensed accidently. This will be obvious from the Figures, where the more the cap 10 is flexed, the more the aperture 28 becomes aligned with the open end 12, and conversely the less the cap 10 is flexed, the less the aperture 28 becomes aligned with the open end 12. Thus, thicker items 16 may require the cap 10 to be flexed more to be dispensed from the tube, and thinner items 16 may require the cap 10 to be flexed less to avoid having multiple items fall out of the tube. It is a simple matter to relieve some of the flexing force on the cap 10 should more than one item 16 start to fall out of the tube 14.

Figure 5:
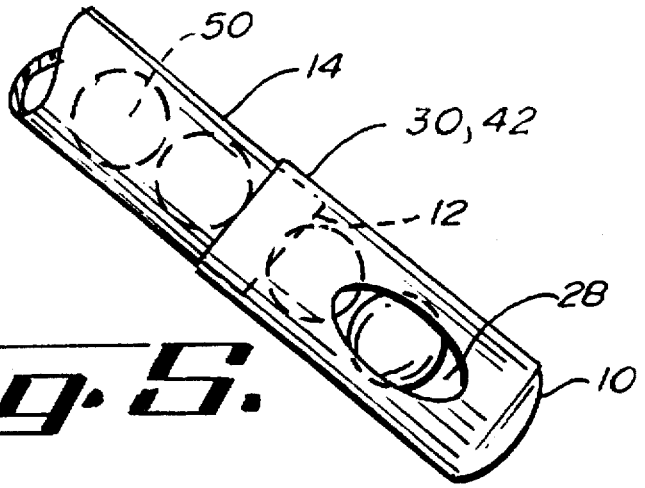
FIG. 5 is a perspective of the invention being used to store small objects such as candy.
Figure 6:
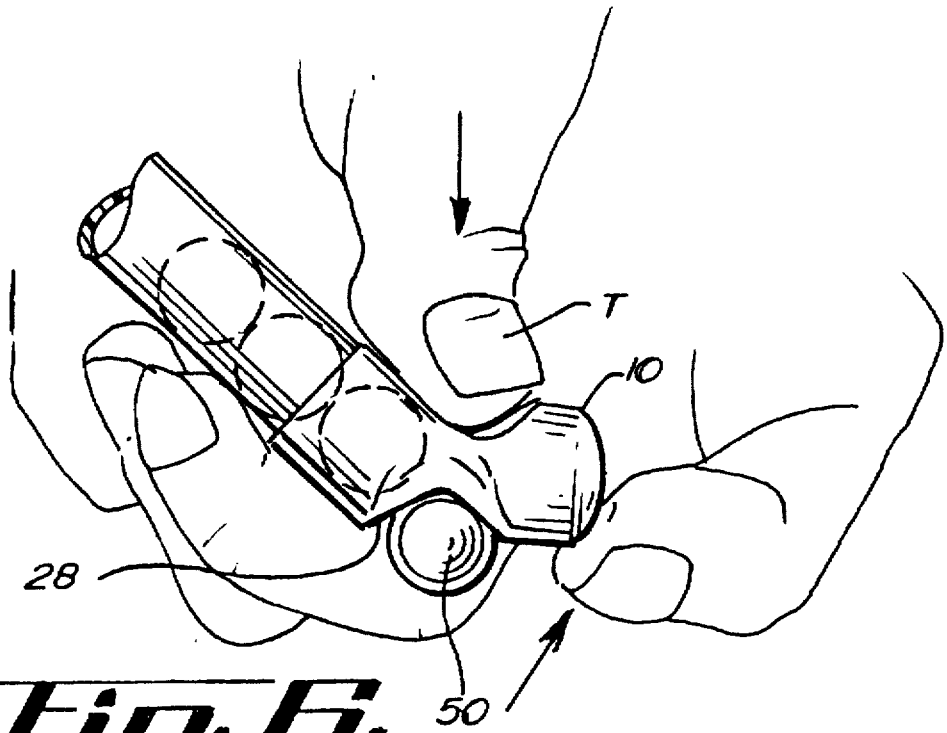
FIG. 6 is a perspective of the invention being used to dispense small objects such as candy.

FIGS. 5 and 6 show the invention being used to store and dispense small objects 50 such as candy. In this application, the apertures 28 are sized to be smaller in cross section than the objects 50. To dispense an object 50, the cap 10 is laterally flexed as shown in FIG. 6, allowing the cross section of the aperture 28 to come into line with the open end 12 of the tube 14. At the same time, as object 50 is manipulated as for example by the thumb T so that as the object 50 is pressed against the aperture 28, the aperture 28 flexes, allowing passage of the object 50.

The aperture 28 may also be used to engage a hook H to hang the cap 10 and tube 14 on the wall W without the need to mold a hanging hook into the cap 10.

The cap 10 may be made of any flexible material such as rubber or flexible plastic.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed:

1. A tube with a flexible cap adapted to enclose the tube, the tube having an open end and used for storing items, the cap being adapted to permit dispensing an item from the tube without removing the cap from the tube and to prevent more than one item from being dispensed, the cap comprising:

a flexible housing having an outer wall, and an inner wall enclosing a space, a bore transecting the outer wall, the inner wall, and the space and forming two apertures at the intersection of the bore with the walls, and an opening through the outer wall and inner wall and intersecting the space, the opening being adapted to engage the open end of the tube, and whereby the cap may be bent by lateral flexion to align one of the apertures with the open end of the tube, thereby allowing an elongate item to be dispensed from the tube under the influence of gravity without removing the cap, the alignment of the aperture being controlled by the amount of lateral flexion so as to prevent more than one item from being dispensed accidentally.

2. The cap of claim 1, wherein the bore is adapted to receive a hook for hanging the cap and tube.

3. The cap of claim 1, wherein the cap is made of rubber.

4. The cap of claim 1, wherein the cap is made of flexible plastic.

5. A flexible cap adapted to enclose a tube having an open end and used for storing items, the cap being adapted to permit dispensing an item from the tube without removing the cap from the tube, the cap comprising:

an enclosure having an opening at one end, a closed end, and a side wall and enclosing a space, an aperture through the side wall, intersecting the space between the opening and the closed end, the opening being adapted to engage the open end of the tube, and whereby the cap may be bent by lateral flexion to align the aperture with the open end of the tube, thereby allowing an item to be dispensed from the tube under the influence of gravity without removing the cap, the alignment of the aperture being controlled by the amount of lateral flexion so as to prevent more than one item from being dispensed accidently.

6. The cap of claim 5, wherein the aperture is adapted to receive a hook for hanging the cap and tube.

7. The cap of claim 5, wherein the cap is made of rubber.

8. The cap of claim 5, wherein the cap is made of flexible plastic.

9. A flexible cap adapted to enclose a tube having an open end and used for storing items, the cap being adapted to permit dispensing an item from the tube without removing the cap from the tube, the cap comprising:

an enclosure having an opening at one end, a closed end, and side walls and enclosing a space, a pair of aligned apertures through the side walls, forming with the space a bore through the enclosure transverse to the axis of the enclosure between the opening and the closed end, the opening being adapted to engage the open end of the tube, and whereby the cap may be bent by lateral flexion to align one of the apertures with the open end of the tube, thereby allowing an item to be dispensed from the tube under the influence of gravity without removing the cap, the alignment of the aperture being controlled by the amount of lateral flexion so as to prevent more than one item from being dispensed accidently.

10. The cap of claim 9, wherein the apertures are adapted to receive a hook for hanging the cap and tube.

11. The cap of claim 9, wherein the cap is made of rubber.

12. The cap of claim 9, wherein the cap is made of flexible plastic.

13. A flexible cap adapted to enclose a tube having an open end and used for storing items, the cap being adapted to permit dispensing an item from the tube without removing the cap from the tube, the cap comprising:

a flexible housing having an outer wall and an inner wall enclosing a space, a pair of aligned apertures through the outer wall and inner wall and a bore through the housing transverse to the axis of the housing and meeting said apertures.

14. The cap of claim 13, wherein the apertures are adapted to receive a hook for hanging the cap and tube.

15. The cap of claim 13, wherein the cap is made of rubber.

16. The cap of claim 13, wherein the cap is made of flexible plastic.

* * * * *